US007878676B2

(12) United States Patent
Helenowski

(10) Patent No.: US 7,878,676 B2
(45) Date of Patent: Feb. 1, 2011

(54) COSMETIC HOUSING

(76) Inventor: Jacek Helenowski, 4300 W. North Ave, Stone Park, IL (US) 60165

( * ) Notice: Subject to any disclaimer, the term of this patent is extended or adjusted under 35 U.S.C. 154(b) by 101 days.

(21) Appl. No.: 12/229,162

(22) Filed: Aug. 20, 2008

(65) Prior Publication Data

US 2010/0046209 A1 Feb. 25, 2010

(51) Int. Cl.
*F21V 33/00* (2006.01)

(52) U.S. Cl. ..... 362/137; 362/155

(58) Field of Classification Search ..... 362/135–144
See application file for complete search history.

(56) References Cited

U.S. PATENT DOCUMENTS

| | | | |
|---|---|---|---|
| 1,496,575 | A | 6/1924 | Hanna |
| 1,742,958 | A | 1/1930 | Kaufman |
| 1,875,650 | A | 9/1932 | Pemberton et al. |
| 2,094,006 | A | 9/1937 | O'Moore-Farrell |
| 2,185,149 | A | 12/1939 | Hallbauer |
| 2,258,542 | A | 10/1941 | Cressaty |
| 2,269,750 | A | 1/1942 | Baird |
| 2,494,375 | A | 1/1950 | Bates et al. |
| 2,512,476 | A | 6/1950 | Birnkrant et al. |
| 2,651,709 | A | 9/1953 | Ross et al. |
| 2,678,995 | A | 5/1954 | Miller |
| 2,779,344 | A | 1/1957 | Hemmings et al. |
| 3,163,364 | A | 12/1964 | Ritter et al. |
| 3,619,596 | A | 11/1971 | Jackson |
| 3,714,411 | A | 1/1973 | Waters et al. |
| 3,937,320 | A | 2/1976 | Chao et al. |
| D243,124 | S | 1/1977 | Horowitz |
| 4,126,145 | A | 11/1978 | Boyd |
| D276,471 | S | 11/1984 | Lo |
| 4,888,667 | A | 12/1989 | Hwang |
| 4,905,128 | A | 2/1990 | Caires |
| 5,025,354 | A | 6/1991 | Kondo |
| 5,034,658 | A | 7/1991 | Hiering et al. |
| 5,036,441 | A | 7/1991 | Herron |
| 5,178,478 | A | 1/1993 | Ryder |
| D354,373 | S | 1/1995 | Khoury |
| D386,828 | S | 11/1997 | Pullman |
| 5,688,037 | A | 11/1997 | Chen |
| 5,860,755 | A | 1/1999 | Bunk |
| 5,983,905 | A | 11/1999 | Patching |
| D424,244 | S | 5/2000 | Gerbron |
| 6,224,236 | B1 | 5/2001 | Shu |
| D467,039 | S | 12/2002 | Fuller |
| D468,059 | S | 12/2002 | Fuller |
| D471,324 | S | 3/2003 | Kalin |
| D473,974 | S | 4/2003 | Fuller |
| D480,513 | S | 10/2003 | Fuller |
| 6,789,972 | B2 | 9/2004 | Nadel |
| D505,519 | S | 5/2005 | Korba |
| 6,991,345 | B2 | 1/2006 | Helenowski |
| 7,270,440 | B2 | 9/2007 | Levy et al. |
| D565,248 | S | 3/2008 | Squirewell |
| 2002/0002758 | A1 | 1/2002 | Stura et al. |

*Primary Examiner*—Jason Moon Han
(74) *Attorney, Agent, or Firm*—Susan L. Lukasik

(57) ABSTRACT

A cosmetic housing (100) includes a first member (101) and a second member (103) couplable with the first member (101), such that a cosmetic (501) is enclosed between the first member (101) and the second member (103), wherein a surface of the first member (101) extends partially and not completely along a part of the outer surface of the second member (103), wherein the first member (101) retains the second member (103).

13 Claims, 1 Drawing Sheet

FIG. 1
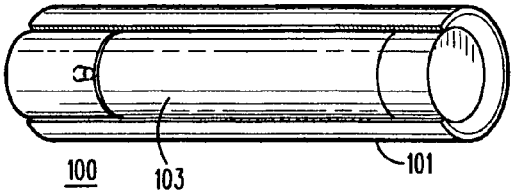
FIG. 2
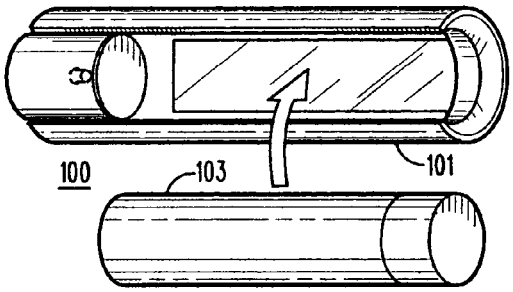
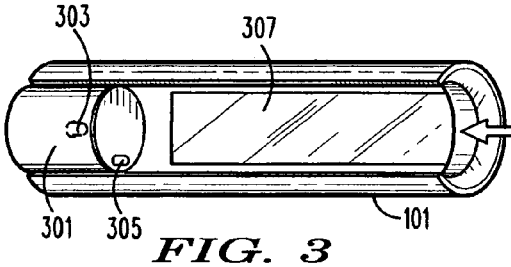
FIG. 3
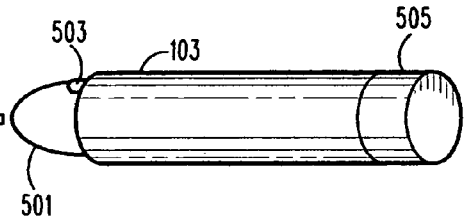
FIG. 5
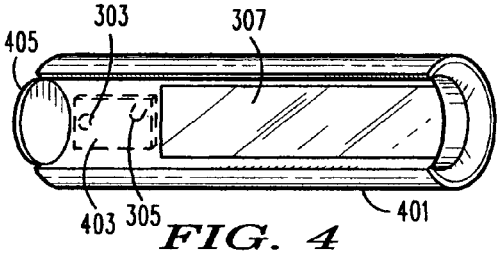
FIG. 4
FIG. 6
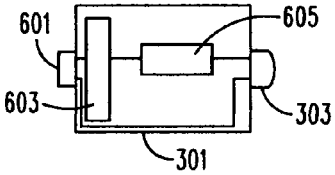
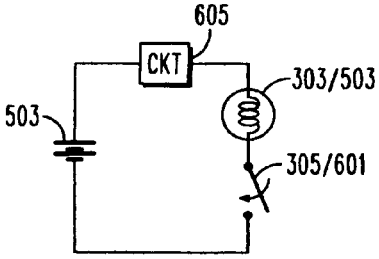
FIG. 7
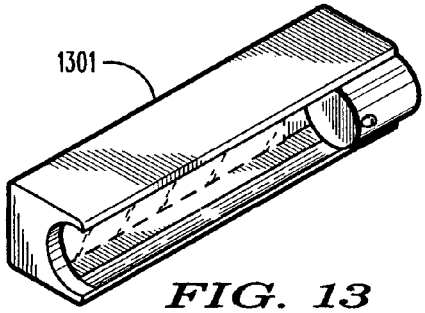
FIG. 13
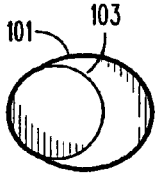
FIG. 8
FIG. 9
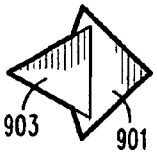
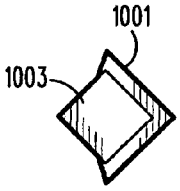
FIG. 10
FIG. 11
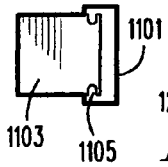
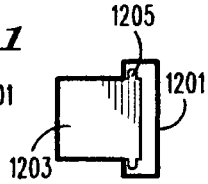
FIG. 12

COSMETIC HOUSING

CROSS-REFERENCE TO RELATED APPLICATIONS

Reference is made to U.S. patent application Ser. No. 29/310,472, filed on the same day as the present application and issued as U.S. Pat. No. D602,637 S, and to U.S. patent application Ser. No. 29/316,243, a divisional application of U.S. patent application Ser. No. 29/310,472 and issued as U.S. Pat. No. D610,310 S.

FIELD OF THE INVENTION

This invention relates to illumination, including, but not limited to, illumination sources disposed in portable housings, for example, cosmetic housings.

BACKGROUND OF THE INVENTION

Cosmetics come in various different types, such as lipstick, mascara, eyeliner, and so forth. In order to apply cosmetics, one needs to see the area on which the cosmetic is to be applied. Often a mirror is utilized to apply cosmetics to oneself, but carrying a mirror can be inconvenient, especially when it is dark and one needs to dig in one's purse, bag, or knapsack to find the mirror.

Accordingly, there is a need for an apparatus that more conveniently facilitates the application of cosmetics.

BRIEF DESCRIPTION OF THE DRAWINGS

FIG. 1 is a perspective view of a cosmetic housing in accordance with the invention.

FIG. 2 is a perspective view of a cosmetic housing showing a snapable coupling in accordance with the invention.

FIG. 3 and FIG. 4 are perspective views of embodiments of a first member of the cosmetic housing in accordance with the invention.

FIG. 5 is a perspective view of a second member of the cosmetic housing in accordance with the invention.

FIG. 6 is a cross section showing a manual switch in conjunction with a light source in accordance with the invention.

FIG. 7 is an electrical diagram for the light source in accordance with the invention.

FIG. 8, FIG. 9, FIG. 10, FIG. 11, FIG. 12, and FIG. 13 show various coupling mechanisms for the cosmetic housing in accordance with the invention.

DESCRIPTION OF A PREFERRED EMBODIMENT

The following describes a cosmetic housing that optionally includes one or more reflective surfaces and one or more light sources. The reflective surface may advantageously be protected between two parts of the housing that are slidably and/or snapably coupled to provide for two-handed use of the cosmetic. The light source may be activated automatically or manually to facilitate convenient application of cosmetics in any lighting conditions. The housing may also protect the light source.

A perspective view of a cosmetic housing 100 with a light source and a reflective surface is shown in FIG. 1. A first member 101 of the housing couples with a second member 103 of the housing so that the first member 101 retains the second member 103 without surrounding the entire outer perimeter of the second member 103 as prior cosmetics do, e.g., a cylinder surrounding a smaller cylinder. The second member 103 thus does not fit entirely within the first member 101 when the housing 100 is closed. One surface of the first member 101 extends partially and not completely along a part of the outer surface of the second member 103. Thus, a part of the first member 101 retains a part of the second member 103 without the first member 101 fully surrounding the entire outer circumference of the second member. The second member 103 may slide axially into the axial slot in the first member 101 and/or may snap into the axial slot in the first member 101, e.g., in a radial direction, such as shown in FIG. 2. The first member 101 may be made of materials known in the art for cosmetic cases, such as plastic, metal, wood, composites, coated materials, and so forth. The second member 103 is advantageously made of a slightly flexible material, such as plastic or metal, to facilitate coupling.

A perspective view of a first member 101 of the cosmetic housing is shown in FIG. 3, as shown when the first member 101 and second member 103 are separated. A segment 301 having a cavity contains a power source and circuitry (see FIG. 6 and FIG. 7) for a light source 303. A reflective surface 207, for example, a mirror, polished plastic, polished metal, or other reflective surface, is disposed on the first member 101, and as shown, is protected between the first member 101 and second member 103 when the cosmetic housing 100 is at least partially closed. The reflective surface 207 may be recessed into, flush with, or surface mounted on the first member 101. The reflective surface 207 may be flat, convex, or concave. The reflective surface 307 may include tempered or shatter-resistant glass or safety glass or plastic. The reflective surface 307 may be disposed internally or externally on the cosmetic housing 100, on either or both members 101 and 103, and more than one reflective surface 307 may be utilized.

The light source 303 may be recessed into, flush with, or extend from the first member 101 or the second member 103. The light source 303 may be one or more light emitting diodes (LEDs), a plasma light source, an electroluminescent light source, and so forth, or any combination thereof. The light source 303 may be a single elongated bulb or a plurality of bulbs or LEDs. The light source 303 may provide a one or more different colors, such as may be provided by bulbs/LEDs of different colors, and/or the light source 303 may provide a variety of different lighting levels, such as may be provided by a dimmer switch (not shown). A light source 303 that is energy efficient by nature also provides advantage. Although the light source 303 is shown extending from an outer surface of the first member 101, the light source 303 may be located anywhere along the outer surface or inner surface of the first member 101 or it may be located on the second member 103, such as shown in FIG. 5. The light source 303 may be disposed at any angle, including angles not perpendicular to the housing 100, and may, for example, be disposed at an angle that results in illumination of the reflective surface 307, the user's face or a part thereof, or the end of the cosmetic. The light source 303 may be used as a flashlight when directed externally to the cosmetic housing 100. An optional automatic switch 305 may be placed at the outer edge of the segment 301, such that when the first member 101 and the second member 103 are closed or nearly closed, the light source 303 is turned off, and when the members 101 and 103 are separated, the light source 303 illuminates, in the same way a refrigerator light turns on when its door is opened, e.g., with a spring-loaded switch.

A perspective view of an alternative embodiment of a first member 401 of the cosmetic housing is shown in FIG. 4, as shown when the first member 101 and second member 103 are separated. A cavity 403 along the length of the first member 101 contains a power source and circuitry (see FIG. 6 and FIG. 7) for the light source 303. The cavity 401 may have an access panel along the back side of the first member 401 or behind the light source 303 on the front side of the first member 401. The reflective surface 207 and light source are described above. The optional automatic switch 305 may extend from the cavity 403 or be disposed along the interior surface of the first member 401. An end piece 405 may be a separate part that, for example, fits in a slot on the first member 401 or may be formed integrally with the first member 401, e.g., in the same molding process.

A perspective view of the second member 103 of the cosmetic 501 housing is shown in FIG. 5, as shown when the first member 101 and the second member 103 are separated. One example of placement for a light source 503 is at or near the end of the second member 103 such that the light source 503 directs light toward the user or other intended target. The light source 503 may extend beyond the edge of the second member 103 or may be flush with or recessed within the second member 103. The cosmetic 301, which may be, for example, lipstick, mascara, or eyeliner, is disposed between the first member 101 and the second member 103 when the cosmetic housing is closed and may optionally contain a retractor 505 that extends and retracts the cosmetic if needed or desired, for example, with lipstick. The power source and any control circuitry may be disposed in the same region as the retractor 505 when the light source is disposed in the second member 103.

A cross section of the segment 301 of first member 101 (as shown in FIG. 3) with a manual switch 601 in conjunction with a light source is shown in FIG. 6. The optional manual switch 601 is shown disposed on the first member 101, and may advantageously extend from the segment 301. The manual switch 601 may be, for example, a slide switch, push button switch, rocker switch, thermally conductive switch, touch switch, or other switch suitable to this application. The manual switch 601 connects to a power source 603, such as one or more batteries, which is connected to optional control circuitry 605, such as a voltage regulator and/or other circuitry that controls the light source 303, shown as an LED extending from the segment 301. The power source 603 may be fixed or replaceable, and may have its own compartment separate from the remainder of the circuitry with a removable lid (not shown). A conductor from the light source 303 to the switch 601 completes the circuit.

An electrical diagram for the light source is shown in FIG. 7. The power source 603 powers the light source 303/503 when the switch 305/601 is closed. The power source 603 is appropriately orientated to illuminate the light source 303/503, as known in the art. When the switch 305/601 is open, the light source 303 is not activated. The optional voltage regulator and/or other circuitry controls 605 the light source 303 as needed, including directing the appropriate voltage and/or current to the light source 303/503, as well as providing over-voltage and/or over-current protection.

FIG. 8, FIG. 9, FIG. 10, FIG. 11, FIG. 12, and FIG. 13 show various alternative embodiments of slidable/snapable coupling mechanisms for the cosmetic housing in accordance with the invention. FIG. 8 illustrates an end view of the cosmetic housing 100 shown in FIG. 1 through FIG. 5. The first member 101 is shown with a cylindrical shape that fits in a partially cylindrical slot with the second member 103, that may be an oval or circular shape. The cosmetic housing 100 may take on other shapes than curved ones, and may take on any combination of shapes. FIG. 9 and FIG. 10 illustrate end views of other shapes, e.g., triangular and diamond, respectively. The first member 901 or 1001 slidably and/or snapably couples with the second member 903 or 1003, respectively, i.e., triangle in triangle or diamond/square in diamond/square or triangle. The slidable and/or snapable coupling may also be provided by one or more bump-dimple contacts or rail-slot connections 1105 or 1205, such as shown in FIG. 11 and FIG. 12. An embodiment showing members having different shapes is shown in FIG. 13, which combines a square or rectangular first member 1301 with a cylindrical second member 103 as shown in FIG. 1, FIG. 2, and FIG. 5. The first member 1301 extends around the second member 103 slightly beyond the diameter of the second member 103 to retain via a snapable and/or slidable coupling. One or more reflective surfaces 307 and/or light source(s) 303 may be combined with these alternative embodiments such as described above. A switch 305 or 601 may also be provided as described above.

The present invention provides a cosmetic housing that has two members that are retained without one member fully surrounding the other member, as done with prior cosmetic housings. A reflective surface may be disposed on an inner surface of one member, such that the reflective surface is conveniently located and protected when the cosmetic is closed. The cosmetic housing is simple and easy to use with two hands, rather than other more complicated designs that use multiple parts and appear to need more than two hands to manipulate easily. One or more reflective surfaces and one or more light sources may be provided in numerous locations. The light source may be protected within the cosmetic housing when closed or may be externally mounted for use as a flashlight. The light source may automatically turn off the when the housing is closed, and activate when the members of the housing separate. Automatic and manual activation of the light source is provided. The mirror and light may be advantageously maintained separately from the cosmetic to keep the cosmetic from fouling them. The invention provides for a convenient and elegant way to apply cosmetics with only two hands, without having to carry a separate cosmetic, mirror, and light source. The members may take on any combination of shapes.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A cosmetic housing comprising:

a first member comprising an inner surface adjacent to a cavity disposed in the first member, which cavity is adjacent to an axial slot along an outer length of the first member;

a second member couplable with the first member, such that a cosmetic is enclosed between the first member and the second member, wherein the inner surface of the first member extends partially and not completely along a first radial part of an outer circumference of a tubular section of the second member, wherein an axial length of a second radial part of the outer circumference of the second member is visible through the axial slot when the first member retains the second member at least partially within the cavity;

a reflector disposed on the inner surface of the first member, wherein the reflector is visible through the axial slot when the first member is separated from the second member when the housing is open; and a light source coupled to the cosmetic housing.

2. The cosmetic housing of claim 1, wherein the second member at least one of slidably couples with the first member and snaps into retention with the first member through the axial slot.

3. The cosmetic housing of claim 1, wherein the housing opens when the second member separates from the first member through the axial slot.

4. The cosmetic housing of claim 1, wherein the reflector is a flat mirror.

5. The cosmetic housing of claim 1, wherein the reflector is disposed between the first member and the second member when the first member and the second member are fully closed.

6. The cosmetic housing of claim 1, wherein the outer circumference of the tubular section of the second member is one of circular, triangular, rectangular, and diamond-shaped.

7. The cosmetic housing of claim 1, further comprising a switch that automatically turns on the light source when the first member separates from the second member.

8. The cosmetic housing of claim 1, wherein the light source directs light at an angle non-perpendicular to the cosmetic housing.

9. The cosmetic housing of claim 1, wherein the light source is coupled to the first member.

10. The cosmetic housing of claim 1, wherein the reflector is disposed between the first member and the second member when the first member and the second member are at least partially closed.

11. The cosmetic housing of claim 1, wherein a power source and circuitry for the light source are disposed in the cavity.

12. The cosmetic housing of claim 1, wherein a length of the first member is crescent-shaped and a concave surface of the first member mates with the first part of the outer circumference of the second member that is cylindrically-shaped.

13. The cosmetic housing of claim 1, wherein a power source for the light source is disposed in the cavity, wherein the light source is directed at one of the reflector disposed on the interior surface and within the cavity of the first member, a user of the cosmetic, and an end of the cosmetic.

* * * * *